US005926852A

United States Patent [19]

Hudy

[11] Patent Number: 5,926,852

[45] **Date of Patent: *Jul. 27, 1999**

[54] COMBINATION DRESS AND SWEAT SOCK

[76] Inventor: Michael D. Hudy, 9210 Inkster, Redford, Mich. 48239

[ * ] Notice: This patent is subject to a terminal disclaimer.

[21] Appl. No.: 08/938,663

[22] Filed: Sep. 26, 1997

[51] Int. Cl.[6] ..... A41B 11/00

[52] U.S. Cl. ..... 2/239; 2/241; 66/185

[58] Field of Search ..... 2/239, 241; 66/178 R, 66/182, 183, 185, 186, 187, 179, 188

[56] References Cited

U.S. PATENT DOCUMENTS

| | | | |
|---|---|---|---|
| D. 344,623 | 3/1994 | Blair | D2/989 |
| 876,797 | 1/1908 | Gilbert | 2/239 |
| 1,162,820 | 12/1915 | Taylor | 2/239 |
| 3,995,322 | 12/1976 | Chesebro | 2/239 |
| 4,263,793 | 4/1981 | Safrit et al. | 66/185 |
| 4,702,091 | 10/1987 | Good et al. | 66/171 |
| 4,898,007 | 2/1990 | Dahlgren | 66/185 |
| 5,417,091 | 5/1995 | Moser | 66/178 |

FOREIGN PATENT DOCUMENTS

| | | | |
|---|---|---|---|
| 3329121 | 2/1985 | Germany | 2/239 |
| 686213 | 1/1953 | United Kingdom | 2/239 |

OTHER PUBLICATIONS

Cabela's Fall Sep. 1994 Catalog—pp. 140–141, Socks.

*Primary Examiner*—Gloria Hale
*Attorney, Agent, or Firm*—Goldstein & Canino

[57] ABSTRACT

A combination dress and sport sock, for use on feet having a heel portion, a bottom, and a toe portion. The sock has an upper portion and a lower portion. The upper portion is made to resemble a dress sock, being made of a darkly colored synthetic fiber. The lower portion is made of thick, comfortable cotton. The upper portion and lower portion are separated by a seam, which extends fully around the foot, parallel to the bottom of the foot, a short and constant distance above the bottom of the foot.

2 Claims, 1 Drawing Sheet

COMBINATION DRESS AND SWEAT SOCK

BACKGROUND OF THE INVENTION

The invention relates to a combination dress and sweat sock. More particularly, the invention relates to a sock having advantages of both conventional dress socks, and sweat socks.

Most clothes either have comfort, or style. Most comfortable clothes are not considered appropriate in situations where formal clothes is called for. In addition, most formal clothes are not comfortable to wear for more than a few hours.

In the workplace, most people are required to wear dress clothes. In some occupations, men are required to wear a suit every day. With a suit, a man must always wear dress socks, since a portion of the sock is visible between the shoe and pant leg, especially when seated.

Dress socks are typically very thin, made of nylon and similar materials. They provide very little cushioning between the foot and shoe, and have very poor moisture absorbing properties. Thus, over the course of a work day that is eight hours or longer, the socks become uncomfortable, and can even begin to smell.

Ordinary "sport" socks are made of thick cotton, are very comfortable, and can absorb a great deal of moisture. They are typically white, and do not have the proper appearance necessary to be worn with dress shoes and dress clothes.

While these units may be suitable for the particular purpose employed, or for general use, they would not be as suitable for the purposes of the present invention as disclosed hereafter.

SUMMARY OF THE INVENTION

It is an object of the invention to provide a sock that is comfortable to wear, and yet still provides a conservative dress appearance to others.

It is a further object of the invention to provide a sock which maintains comfort by providing a lower portion that is made of thick cotton.

It is a still further object of the invention to provide a sock which maintains a conservative dress appearance by providing an upper portion that is made of thin, darkly colored synthetic fabric.

It is yet a further object, that only the upper portion is visible to observers when a shoe is worn over the sock, the lower portion remains concealed within the shoe.

The invention is a combination dress and sport sock, for use on feet having a heel portion, a bottom, and a toe portion. The sock has an upper portion and a lower portion. The upper portion is made to resemble a dress sock, being made of a darkly colored synthetic fiber. The lower portion is made of thick, comfortable cotton. The upper portion and lower portion are separated by a seam, which extends fully around the foot, parallel to the bottom of the foot, a short and constant distance above the bottom of the foot.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
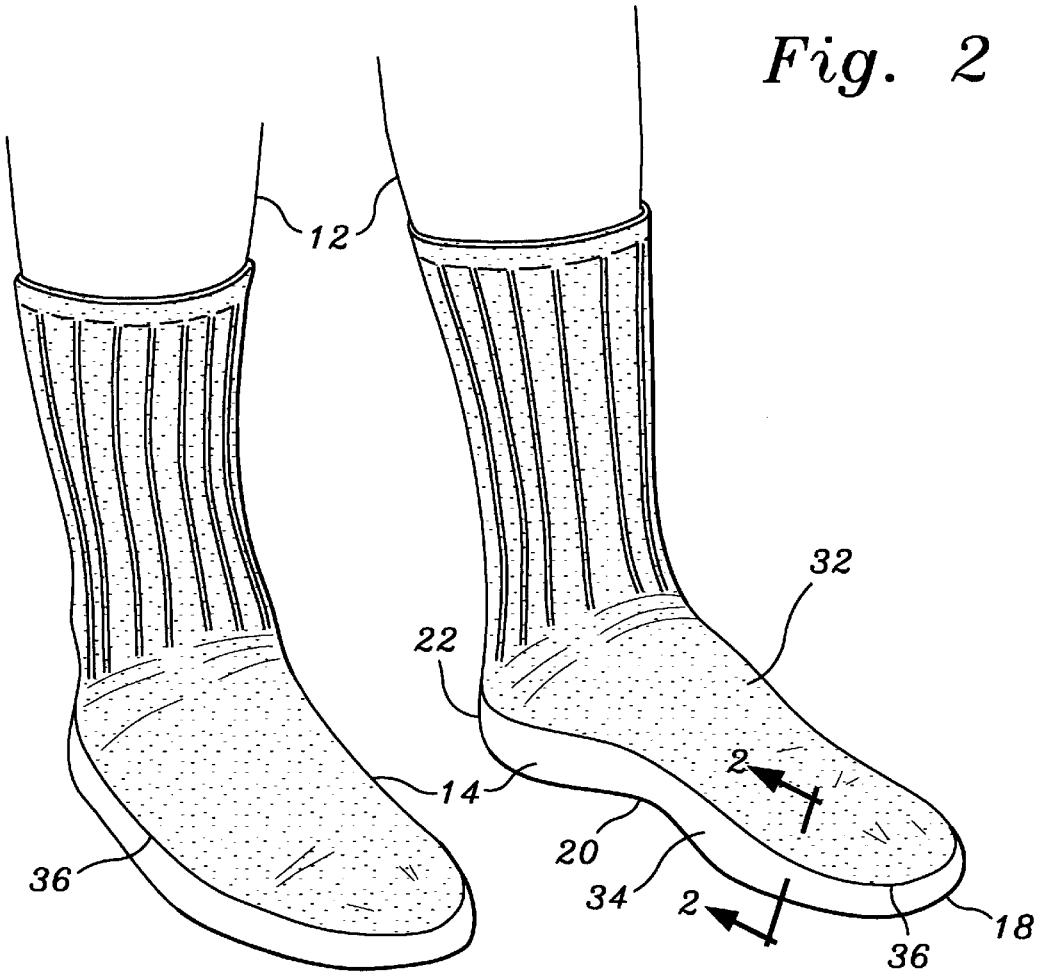
FIG. 1 is a diagrammatic view of the invention, in place on a pair of feet.

FIG. 1 illustrates a user, having a pair of legs 12, each having a foot 14, and an ankle 16. The foot has a toe portion 18, a bottom 20, and a heel portion 22.

A sock 30 is positioned over the feet 14. The sock comprises an upper portion 32 and a lower portion 34. The lower portion 34 covers the bottom 20 of the foot 14, and extends upward to a connecting seam 36. The connecting seam 36 extends parallel to the bottom 20 of the foot 14 above the bottom 20 of the foot 14, extending completely around the foot 14 from the toe portion 18 to heel portion 22 while maintaining a fixed distance from the bottom 20 of the foot 14.

Figure 2:
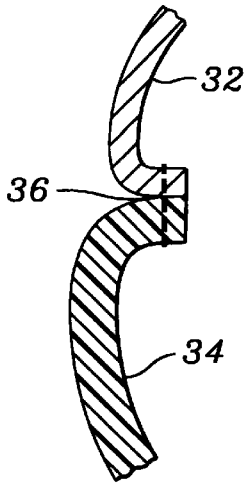
FIG. 2 is a cross sectional view, taken along line 2—2 in FIG. 1.

Referring to FIG. 2, it is apparent that the lower portion 34 is much thicker than the upper portion 32. The upper portion is made to look like a typical dress sock: it is thin, darkly colored, having ribs 38, and made of a synthetic fabric. The lower portion is made of cotton, and is similar to a typical "sweat" or sport sock: it is thick, soft and fluffy, and moisture absorbent.

Once the socks 30 are donned by the user, they are partially covered by dress shoes. In fact, the dress shoes conceal the entire lower portion 34. Thus, only the upper portion 32, which has a formal dress appearance, is be viewable by observers. The user benefits from the soft, comfortable, absorbent, and hidden lower portion 34.

What is claimed is:

1. A combination dress sock and sport sock, for use on feet, each having a bottom, a heel portion and toe portion, comprising:

a lower portion made of cotton;

an upper portion made of synthetic fabric that is thinner than the lower portion; and a seam connecting the lower portion and upper portion, the seam extending above the bottom, extending fully around the foot from heel portion to toe portion, and extending at a constant height from the bottom; and wherein the cotton is uncolored, and the synthetic fabric is darkly colored to provide the appearance of a dress sock.

2. The combination dress sock as recited in claim 1, wherein the upper portion has vertical ribs.

* * * * *